US008121834B2

(12) United States Patent
Rosec et al.

(10) Patent No.: US 8,121,834 B2
(45) Date of Patent: Feb. 21, 2012

(54) METHOD AND DEVICE FOR MODIFYING AN AUDIO SIGNAL

(75) Inventors: Olivier Rosec, Lannion (FR); Didier Cadic, Guingamp (FR)

(73) Assignee: France Telecom, Paris (FR)

( * ) Notice: Subject to any disclaimer, the term of this patent is extended or adjusted under 35 U.S.C. 154(b) by 1015 days.

(21) Appl. No.: 12/075,759

(22) Filed: Mar. 12, 2008

(65) Prior Publication Data

US 2008/0255830 A1 Oct. 16, 2008

(30) Foreign Application Priority Data

Mar. 12, 2007 (FR) ..... 07 53759

(51) Int. Cl.
*G10L 21/00* (2006.01)

(52) U.S. Cl. ..... 704/224; 704/200; 704/205

(58) Field of Classification Search ..... 704/200, 704/205, 224
See application file for complete search history.

(56) References Cited

U.S. PATENT DOCUMENTS

| | | | | |
|---|---|---|---|---|
| 5,504,833 | A * | 4/1996 | George et al. | 704/211 |
| 7,478,039 | B2 * | 1/2009 | Stylianou et al. | 704/207 |
| 7,792,672 | B2 * | 9/2010 | Rosec et al. | 704/246 |
| 2005/0065784 | A1 * | 3/2005 | McAulay et al. | 704/205 |

FOREIGN PATENT DOCUMENTS

WO WO 2006/106466 A 10/2006

OTHER PUBLICATIONS

Moulines E., et al., "Non-parametric techniques for pitch-scale and time-scale modification of speech", Speech Communication, Elsevier Science Publishers, Amsterdam, NL, vol. 16, No. 2, Feb. 1995, pp. 175-205.

* cited by examiner

*Primary Examiner* — Daniel D Abebe
(74) *Attorney, Agent, or Firm* — Cozen O'Connor

(57) ABSTRACT

A method of modifying acoustic characteristics of an original audio signal as a function of modification instructions relating at least to the fundamental frequency and the spectral envelope of the original signal. The method comprises a first modification operation applied to the original signal to deliver an intermediate audio signal, the first modification operation being intended to deform the spectral envelope of the original signal in application of said spectral envelope modification instruction; and a second modification operation applied to the intermediate signal to deliver a final audio signal, the second modification operation being intended to modify at least the fundamental frequency of the intermediate signal, in application of a modification factor that is determined so as to take account of the effects of the first modification operation on the fundamental frequency of the original audio signal, so that the fundamental frequency obtained for the final signal conforms to said instruction relating to fundamental frequency.

9 Claims, 2 Drawing Sheets

T0
1
2
3
4
5

1
2
3
3
4
5
2
$T0_s$
3
3

1
2
3
3
4
5
$T0_s$

METHOD AND DEVICE FOR MODIFYING AN AUDIO SIGNAL

RELATED APPLICATION

This application claims the priority of French application Ser. No. 07/53759 filed Mar. 12, 2007, the entire content of which is hereby incorporated by reference.

FIELD OF THE INVENTION

The present invention relates generally to the field of processing audio signals and more precisely to techniques aiming to modify characteristic parameters of an audio signal. Thus the invention relates to a method and a device for modifying acoustic characteristics of an audio signal as a function of modification instructions relating at least to the fundamental frequency and to the spectral envelope of the signal. The invention applies in particular to speech signals.

BACKGROUND OF THE INVENTION

In the description below, detailed references are given in the list of documents at the end of the description for documents cited with the reference in abbreviated form in square brackets ([ . . . ]).

Digitized speech modification techniques prove very useful in numerous speech processing applications. In speech synthesis, they provide prosody modifications (modification of pitch and rhythm) that are often necessary to confer an acceptable intonation on a synthesized speech signal. In the field of voice conversion, the objective is to modify the speech signal from a source speaker so that it appears to have been spoken by a required target speaker. For this, adaptation of timbre and pitch are necessary. There are also voice transformation applications seeking to modify perceived speech only on the basis of a set of target descriptors (low/high voice, masculine/feminine/child-like voice, robot voice, etc.).

Most known speech modification techniques essentially aim to modify three types of parameters:

Perceived pitch, measured by the fundamental frequency of the speech signal concerned, i.e. the frequency of vibration of the vocal chords.

Speed, directly related to the time taken to pronounce the various phonemes of the speech signal concerned. This time could be the total duration of an ordinary sentence, for example.

Timbre, which can be defined as the perceptual attribute that characterizes the difference between two sounds otherwise similar in terms of pitch, intensity, and duration. The timbre comprises both an information component (linked to the phonemes spoken) and an identity component (linked to the speaker: for example, a voice that is hoarse, clear, gentle, etc.). The timbre is often described by the spectral envelope of the speech signal. The spectral envelope is the envelope curve of the amplitudes of the spectrum peaks seen in the speech signal.

The above three parameter types are not independent of one another, in the sense that a modification applied to one of these parameters necessarily affects the others. This implies modifying these parameters consistently. In particular, combined modification of pitch and timbre is necessary to preserve the natural sound of the resulting speech. For example, it is demonstrated in the document [Syr85] (see list of reference documents at the end of the description) that the first formant and the fundamental frequency are closely linked, so that any change to one of these parameters must be accompanied by an appropriate modification to the other. A formant corresponds to a resonance of the vocal tract, and is characterized by its center frequency and its bandwidth. That center frequency is reflected by a peak in the spectral envelope.

Speech signal modification techniques that modify the perceived pitch without at the same time modifying the timbre are known. They include the TD-PSOLA and HNM techniques, for example.

The TD-PSOLA (Time Domain Pitch Synchronous Overlap and Add) technique described in European Patent EP0363233, for example, or in the document [Mou95], is based on decomposing a speech signal into short-term and pitch-synchronous analysis signals that are then repositioned on the time axis and juxtaposed progressively. The TD-PSOLA technique makes prosody modifications to the speech signal such as duration expansion/contraction (known as time-stretching) or changing the fundamental frequency (pitch), while at the same time preserving good sound quality. Here "good sound quality" means the absence of breaks, noise, or other artifacts that make a signal uncomfortable for a listener. Thus it does not include the natural aspect of the voice timbre.

However, with the TD-PSOLA technique, although the time-stretching factors used can be as high as 2 without significant distortion of the signal, the possibilities for modifying the fundamental frequency remain relatively limited if the resulting speech signal is to sound natural. In the TD-PSOLA technique, modification of pitch is not accompanied by modification of timbre. As mentioned above, combined modification of pitch and timbre is necessary to preserve the natural sound of the resulting speech.

The voice modification technique based on the HNM model is described in the document [Sty96], for example. The harmonic plus noise model (HNM) has also been used for prosody modification and even for spectral modification. It assumes that a voiced segment (also known as a frame) of the speech signal S(n) can be decomposed into a harmonic portion, representing the quasi-periodic component of the signal consisting of a sum of L harmonic sinusoids each of amplitude $A^l$ and phase $\Phi^l$, and a noise portion representing friction noise and glottal excitation variation from one period to another, modeled by Gaussian white noise exciting an AR (auto-regressive) filter obtained by linear predictive coding (LPC) analysis. For a non-voiced frame, the harmonic portion is absent and the signal is simply modeled by white noise shaped by AR filtering. For synthesis, the amplitude and the phase of the harmonic portion are re-estimated as a function of the required pitch instructions to preserve the timbre of the original signal (i.e. the spectral envelope) as much as possible. This re-estimation is valid for the amplitude information, provided that a sufficiently smooth spectral envelope is available. However, re-estimating phase is much more complex and must allow for phase spectra of the glottal source and the filter characterizing the vocal tract, this information being difficult to extract in both cases. This problem means that the harmonic plus noise model fails to preserve the coherence of the signals that are modified and therefore degrades the quality of the resulting speech.

Unlike the above techniques, other known voice modification techniques operate on perceived pitch and on timbre.

The resampling technique adapts a signal (not necessarily a speech signal) to modification of its sampling frequency. Applied to a speech signal, this technique modifies pitch, timbre, and speed conjointly, preserving excellent sound quality. The resampling technique is described in the document [Mou95]. According to that document, to obtain an integer signal acceleration factor P, low-pass filtering is applied first, after which the signal is decimated by eliminating P-1 samples per P samples. To obtain an audio or speech signal slowing factor Q (Q integer), Q-1 zeros are added between two signal samples, after which low-pass filtering with an appropriate cut-off frequency is applied.

As a general rule, the resampling factor $\gamma$ is not an integer, but can be approximated by a rational number P/Q. When $\gamma$=P/Q, it suffices to combine the two kinds of processing: oversampling by a factor Q followed by undersampling by a factor P.

Generally speaking, if the resampling factor $\gamma$ applied is greater than (or less than) 1, the amplitude spectrum of the speech signal is expanded (or contracted), i.e. the position of harmonics and formants of the signal, represented on the frequency axis, are multiplied (or divided) by $\gamma$. This kind of spectral transformation therefore affects timbre and is also accompanied by multiplication (or division) of the fundamental frequency by the same coefficient ($\gamma$), and therefore acts conjointly on pitch. Resampling is consequently an effective and relatively simple technique for modifying a speech signal, because it modifies timbre and pitch conjointly, with no audible artifacts appearing, because resampling preserves the time coherence of the signal and therefore does not distort the information conveyed.

However, resampling alone cannot effect relevant transformations of fundamental frequency and timbre. Resampling the speech signal causes formants to be shifted pro rata in the same direction as the fundamental frequency. Observation of natural speech signals shows that the range of fundamental frequency variation is much wider than the range of variation of formant frequencies. Applying a resampling factor equal to the required fundamental frequency modification factor is therefore reflected in excessive expansion/contraction of the spectral envelope and therefore significantly degrades the natural sound of the voice, for example causing "pipe voice" or "Donald Duck voice" effects.

Another known technique operates conjointly on perceived pitch and timbre. This technique is described in the document [Kai00] and relies on a spectrum adjustment operation based on the use of a Gaussian mixture model to model pitch and spectral envelope conjointly. Accordingly, the spectral envelope is corrected as a function of the required fundamental frequency instruction, which preserves the natural sound of the transformed speech better, especially if large fundamental frequency modifications are made. This type of technique effects amplitude spectrum transformations that are relatively accurate and well-controlled. However, the phase information of the transformed signals is not well-controlled, which significantly degrades the quality of the resulting signal.

It emerges from the prior art as briefly described above that there is a real need for a speech signal modification technique that modifies conjointly at least the perceived pitch and the timbre associated with the speech signal in order to provide a speech signal of high quality in terms of the perceived resulting voice sounding natural.

SUMMARY OF THE INVENTION

A first aspect of the present invention is directed to a method of modifying acoustic characteristics of an original audio signal as a function of modification instructions relating at least to the fundamental frequency and the spectral envelope of the original signal. This method is noteworthy in that: a first modification operation is applied to the original signal to deliver an intermediate audio signal, the first modification operation being intended to deform the spectral envelope of the original signal in application of said spectral envelope modification instruction; and a second modification operation is applied to the intermediate signal to deliver a final audio signal, the second modification operation being intended to modify at least the fundamental frequency of the intermediate signal, in application of a modification factor that is determined so as to take account of the effects of the first modification operation on the fundamental frequency of the original audio signal, so that the fundamental frequency obtained for the final signal conforms to said instruction relating to fundamental frequency.

An embodiment of the invention can modify the characteristics of an audio signal in application of predefined modification instructions concerning the spectrum envelope and the fundamental frequency of the signal by combining two successive and separate modification operations whose effects are predetermined. One of these operations operates primarily on the spectral envelope of the signal concerned (and thus on the perceived timbre of a speech signal), also with an effect on fundamental frequency, but does not apply the predefined instruction relating to fundamental frequency. The other modification operation essentially affects the fundamental frequency of the signal concerned (and therefore the perceived pitch of a speech signal). However, an advantage of the invention is that this second modification operation has parameters set to modify the fundamental frequency of the audio signal obtained after the first modification, so that the fundamental frequency of the final modified signal conforms to the original instruction relating to fundamental frequency.

Thus, by means of the combination of these two successive audio signal modification steps, a final modified signal is obtained whose spectral envelope and fundamental frequency characteristics conform totally to the initial instructions. The invention as applied to a speech signal guarantees the natural sound of a modified voice, for example, because the signal modification instructions, which are predefined in relation to timbre and pitch, can actually be applied, without a change of timbre (or pitch) degrading the pitch (or the timbre) and producing a modified voice that does not sound natural and/or does not match the required target.

In an embodiment of the invention, the original audio signal modification instructions include a factor $\gamma$ for expanding/contracting the spectral envelope of the original signal along the frequency axis and factors $\beta$ and $\alpha$ for modifying respectively the fundamental frequency and the duration of the original signal. In this embodiment, the first modification operation modifies the fundamental frequency and the duration of the original audio signal in application of second factors $\beta'$ and $\alpha'$, respectively, in addition to the required modification of the spectral envelope. The second modification operation then modifies the fundamental frequency and the duration of the intermediate audio signal in application of third factors $\beta''$ and $\alpha''$, respectively, such that: $\alpha'\cdot\alpha''=\alpha$ and $\beta'\cdot\beta''=\beta$.

Thus by choosing the parameters $\alpha''$, $\beta''$ of the above formulas for the second modification operation as a function of the known modification factors $\alpha'$ and $\beta'$ resulting from the application of the first modification operation to the original audio signal, a final modified audio signal is obtained whose duration, fundamental frequency, and spectral envelope characteristics conform to the original modification instructions $\alpha$, $\beta$, $\gamma$, and therefore to the required target signal.

According to particular features of an embodiment of the invention, the first modification operation is effected by resampling with a resampling factor $\gamma$, a value of $\gamma$ greater than 1 corresponds to expanding the spectral envelope of the signal, and a value of $\gamma$ between 0 and 1 corresponds to contracting the spectral envelope of the signal. The second factors $\beta'$ and α' are respectively defined as a function of the resampling factor γ by the following equations: β'=γ and $$\alpha' = \frac{1}{\gamma};$$

the third factors β" and α" are obtained from the following equations:

$$\beta'' = \frac{\beta}{\gamma}$$

and α"=α·γ.

The second modification operation is effected by a PSOLA technique, for example a TD-PSOLA technique.

In one implementation of the method of the invention, the second modification operation is effected before the first modification operation and the factors β' and α' are determined beforehand as a function of the factor γ.

A second aspect of the invention consists in an audio processor device adapted to modify acoustic characteristics of an original audio signal as a function of modification instructions relating at least to the fundamental frequency and the spectral envelope of the original signal. According to the invention the device includes means for modifying the original audio signal by applying a first modification operation to deliver an intermediate audio signal, the first modification operation being intended to deform the spectral envelope of the original signal in application of said spectral envelope modification instruction; and means for modifying the intermediate signal by applying a second modification operation to deliver a final audio signal, the second modification operation being intended to modify at least the fundamental frequency of the intermediate signal so that the fundamental frequency obtained for the final signal conforms to said instruction relating to fundamental frequency, the fundamental frequency of said intermediate signal being modified by a modification factor that is determined so as to take account of the effects of the first modification operation on the fundamental frequency of the original audio signal.

Another aspect of the present invention provides an audio processing computer program including instructions adapted to execute the method of the invention when the program is loaded into and executed in a data processing system.

BRIEF DESCRIPTION OF THE DRAWINGS

The invention can be more clearly understood after reading the following detailed description given by way of example only and with reference to the drawings, in which.

DETAILED DESCRIPTION OF THE DRAWINGS

Figure 1:
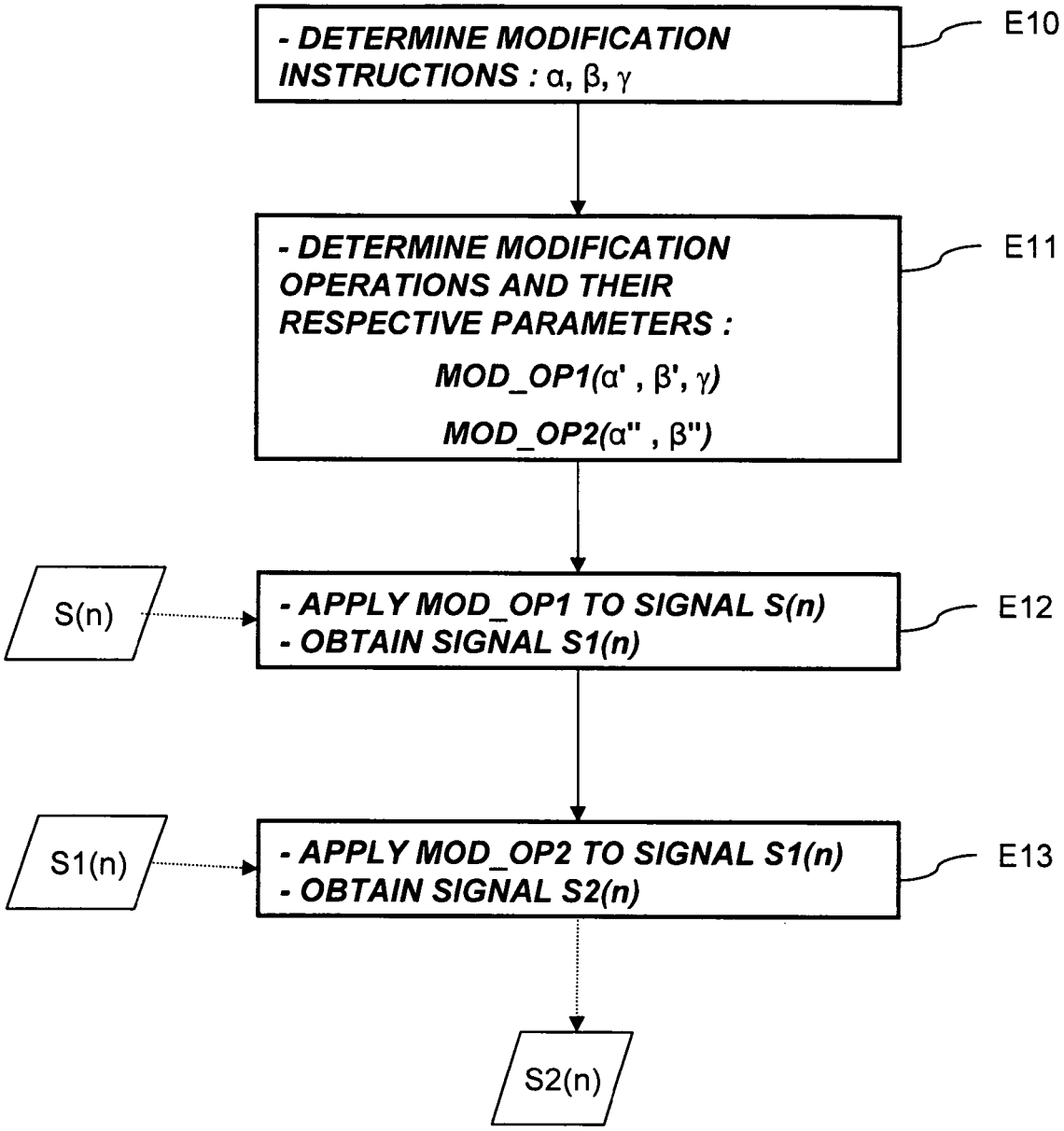
FIG. 1 is a general flowchart showing a method of the invention for modifying acoustic characteristics of an audio signal.

FIG. 1 is a general flowchart showing a method of the invention for modifying acoustic characteristics of an audio signal. The present invention is applicable to audio signals in general (for example music signals) but is particularly effective in relation to speech signals, and consequently the audio signal to be modified referred to in the remainder of the present description of embodiments of the invention is a speech signal.

Referring to FIG. 1, the method of modifying acoustic characteristics of a speech signal, referred to as the "original signal", as a function of modification instructions relating to predefined parameters of the speech signal begins with an initial step E10 of determining the modification instructions to be applied as a function of the required speech signal, i.e. as a function of a "target" signal.

In the embodiment described, the original speech signal modification instructions comprise a factor γ for time stretching the spectral envelope of the original signal along the frequency axis and factors α and β for modifying the duration and the fundamental frequency of the original signal, respectively. The factors α and β are chosen so that if they are greater than 1 they correspond to an increase in the duration and the fundamental frequency of the signal whereas if they are between 0 and 1 they correspond to a reduction of the duration and the fundamental frequency of the signal.

Accordingly, if the audio signal to be modified is a speech signal, the instruction modification factors α, β, and γ respectively modify the following parameters relating to the sound reproduction characteristics of the speech signal: speed, perceived pitch, and perceived timbre.

The parameters α, β, and γ are chosen depending on the required transformation. For example, if major modifications are effected, for example to transform an adult voice into a child-like voice, the signal spectrum envelope time stretching factor γ and the fundamental frequency modification factor β can have the values 1.2 and 3, respectively.

A statistical analysis of variations of fundamental frequency and formant frequencies is given in the document [Hub99] (see in particular the table in Appendix A on page 1540 of that document). This analysis can be used to determine "reasonable" values for the parameters γ and β. Accordingly, to transform a male voice into a female voice, suitable spectral envelope time-stretching factor (γ) and fundamental frequency modification factor (β) values are 1.2 and 1.8, respectively (it is not necessary to modify the duration in this particular circumstance).

The signal duration modification factor α depends essentially on the required speech rhythm. In many voice transformation applications, modifying the speech rhythm is considered of secondary importance and therefore ignored, which corresponds to a factor α equal to 1. However, to obtain very specific effects, for example voices of giants or dwarves, factors that slow or accelerate speech rhythm can be used. Typical values of the factor α can then range between 0.5 and 2.

Referring again to FIG. 1, after the step E10 of determining the modification instructions as a function of the required transformation of the signal, the next step E11 determines accordingly the two successive modification operations to be applied, starting from the original speech signal, and their respective parameters.

Thus, according to the invention, a first modification operation is applied to the original signal S(n) in order to deliver an intermediate audio signal S1(*n*). This first modification operation is intended to deform the spectral envelope of the original signal S(n) in application of the spectral envelope modification instruction γ. Note that here the audio or voice signals considered are in sampled digital form (n designating any sample).

In the selected embodiment, the first modification operation MOD_OP1 that has been chosen (also referred to as the "first transformation"), is implemented by a resampling technique with a factor γ; a value of γ greater than 1 corresponds to expanding the spectral envelope of the signal and a value of γ between 0 and 1 corresponds to contracting the spectral envelope of the signal. A known resampling method of this kind is described in the document [Mou95] cited above. Reference may in particular be made to section 3.2.1 of that document, entitled "Time-domain and frequency-domain resampling". However, in contrast to the resampling technique described in the document [Mou95] that uses resampling to modify pitch, the present invention uses the resampling technique essentially to modify the spectral envelope of the original signal S(n) in application of the spectral envelope modification instruction γ.

However, it is known that, in addition to the required modification according to the invention of the spectral envelope of the original signal, this kind of resampling technique modifies fundamental frequency and duration by respective second factors β' and α'. These second factors β' and α' are respectively defined as a function of the resampling factor γ by the following equations:

$$\beta' = \gamma \text{ and } \alpha' = \frac{1}{\gamma} \tag{1}$$

Thus, according to the invention, the second modification operation MOD_OP2 to be applied to the signal (S1(*n*)) obtained, referred to as the "intermediate signal", following application of the first transformation MOD_OP1 must be chosen so as to take into account the effects of MOD_OP1 on fundamental frequency, so that the fundamental frequency obtained for the final signal (S2(*n*)) conforms to the instruction (β) relating to fundamental frequency. Of course, if there is also an instruction relating to duration (α), as in this embodiment, the second transformation MOD_OP2 must also take account of the effects of the first transformation MOD_OP1 on the duration of the original signal.

Thus, in the embodiment described, the second modification operation is intended to modify the fundamental frequency and the duration of the intermediate signal (S1(*n*)) in application of third factors β" and α", respectively, such that:

$$\alpha'\cdot\alpha''=\alpha \text{ and } \beta'\cdot\beta''=\beta \tag{2}$$

In this way, the overall fundamental frequency and duration transformation effected between the original signal (S(n)) and the final signal (S2(*n*)) corresponds to a transformation by respective factors β and α in application of equations (2) above. In the selected embodiment in which the first modification operation MOD_OP1 is resampling by a factor γ producing fundamental frequency and duration effects in application of the above equations (1), the third factors β" and a" relating to the second transformation MOD_OP2 are obtained from the following equations:

$$\beta'' = \frac{\beta}{\gamma} \text{ and } \alpha'' = \alpha\cdot\gamma \tag{3}$$

In practice, in a preferred embodiment, the second modification operation MOD_OP2 is applied by a Pitch-Synchronous Overlap and Add (PSOLA) technique, and in particular a PSOLA technique applied in the time domain known as TD-PSOLA (Time-Domain PSOLA). The TD-PSOLA technique is described below in the description with reference to FIG. 2.

The second modification operation MOD_OP2 can also be based on techniques such as LP-PSOLA (Linear Prediction PSOLA) or FD-PSOLA (Frequency Domain PSOLA) techniques, a Harmonic plus Noise Model (HNM) technique, or a phase vocoder technique. Using two independent techniques to modify fundamental frequency and duration can even be envisaged.

However, whichever technique is used to modify fundamental frequency, that technique must globally preserve the spectral envelope of the processed signal (here the intermediate signal S1(*n*)), because the spectral envelope of the original signal (S(n)) is essentially modified by the first modification operation MOD_OP1.

Referring again to FIG. 1, once the step E11 of choosing the modification operations MOD_OP1 and MOD_OP2 and their respective parameters has been effected, the modification as such of the original speech signal S(n) is effected by the subsequent steps E12 and E13.

In the step E12, the original signal S1(*n*) is modified by the transformation MOD_OP1, producing an intermediate signal S1(*n*) whose spectral envelope is modified (stretched or contracted) relative to the original signal in application of the spectral envelope modification instruction γ and whose fundamental frequency and duration are modified by the second factors β' and α', respectively.

Finally, in the step E13, the intermediate signal S1(*n*) is processed in application of the transformation MOD_OP2, modifying the fundamental frequency and the duration of the intermediate signal, to obtain the final signal S2(*n*) whose duration, fundamental frequency, and spectral envelope conform to the respective modifications instructions α, β, γ.

In the selected embodiment described, the spectral envelope modification step (MOS_OP1), i.e. the step of modifying the timbre of the speech signal, precedes the step of modifying the prosody parameters (pitch and elocution) respectively linked to the fundamental frequency and the duration of the signal. The order of these operations can be reversed, however, provided that the modification factors of the first step take account of the effects on pitch of the second step, and where applicable on the duration, of the processed signal, in order globally to respect the original signal modification instructions. In particular, in the embodiment described above, the second factors β' and α' of the step MOD_OP2, now executed first, would then be determined beforehand as a function of the factory γ of the step MOS_OP1 executed second.

Figures 2A, 2B, 2C, 2D:
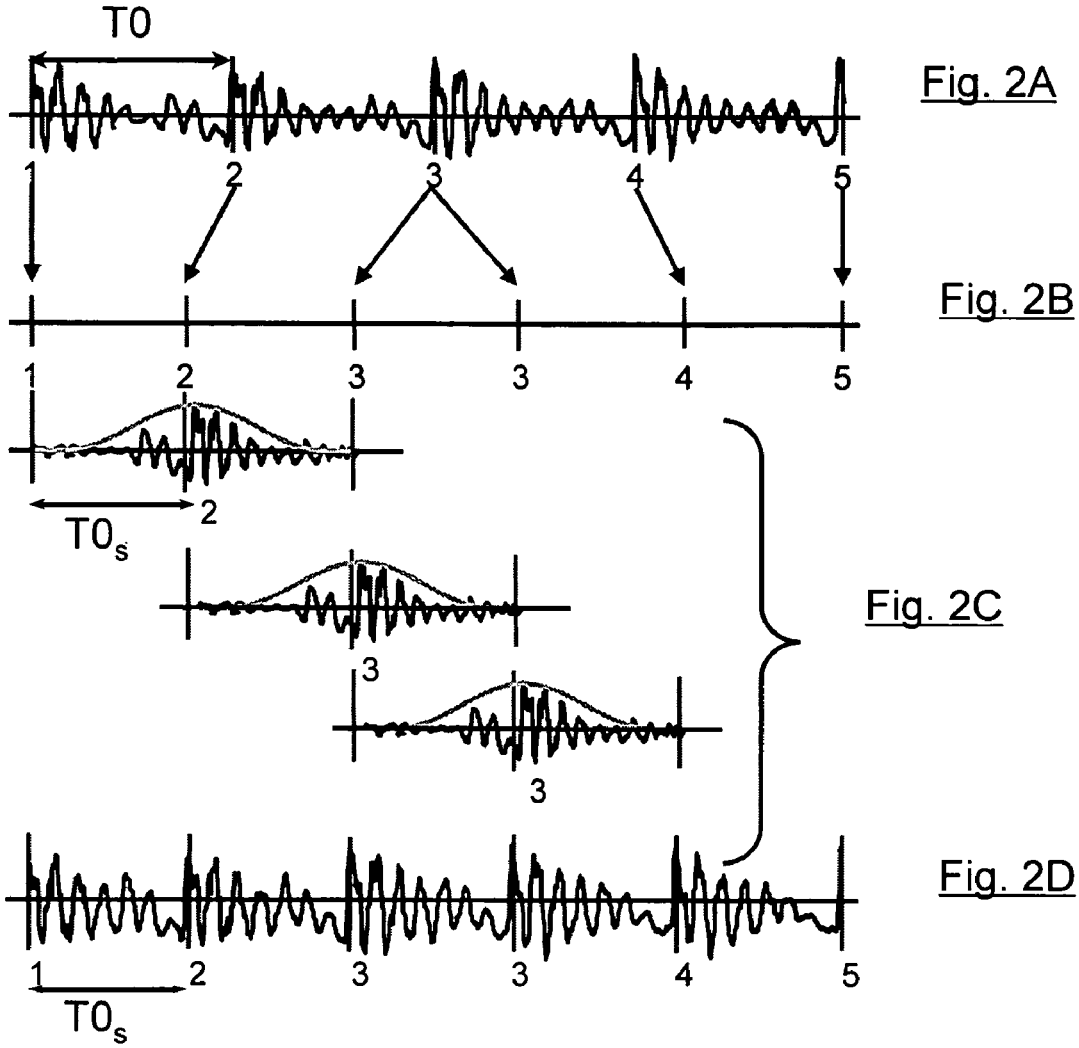
FIGS. 2A to 2D represent stages of processing a speech signal by means of the TD-PSOLA algorithm.

FIGS. 2A-2D represent the main stages of processing a speech signal using the TD-PSOLA algorithm. FIG. 2A represents the speech signal S(n) to be modified.

During a first step illustrated by FIG. 2B, the signal S(n) is segmented into frames in a pitch-synchronous manner whereby each segment has a duration corresponding to the reciprocal of the fundamental frequency of the signal.

The times of closure of the glottis, also called analysis times, are situated in the vicinity of the energy maxima of the speech signal, and TD-PSOLA processing preserves well the characteristics of the speech signal in the vicinity of the ends of the segments obtained by pitch-synchronous analysis. Thus TD-PSOLA performance is optimized if these times are identified sufficiently accurately. Such pitch-synchronous segmentation is obtained, for example, by techniques based on group delays or using the method proposed by D. Vincent, O. Rosec, and T. Chonavel in "Glottal closure instant estimation using an appropriateness measure of the source and continuity constraints", IEEE ICASSP'06, vol. 1, pp. 381-384, Toulouse, France, May 2006.

This pitch-synchronous marking step is preferably carried out off-line, i.e. not in real time, which reduces the computation workload for real-time implementation.

The times separating the segments are modified, as a function of the required modification factors for the fundamental frequency and duration, in application of the following rules:

- to extend the duration, certain segments are duplicated in order to increase artificially the number of glottal pulses;
- to reduce the duration, certain segments are eliminated;
- to increase the fundamental frequency, i.e. to make the voice higher, the analysis times are moved closer together, which may require duplication of segments to preserve the total duration; and
- to reduce the fundamental frequency, i.e. to make the voice lower, the analysis times are moved apart, which may require eliminating segments to preserve the total duration.

A detailed description of these rules can be found in the document [Mou95], in particular in sections 4.2.1 to 4.2.3 of that document.

After this step, the signal obtained comprises an integer number of segments or frames each having a duration corresponding to a period that is the reciprocal of the modified fundamental frequency, as shown in FIG. 2B.

The modification processing thereafter comprises windowing the signal around the analysis times, i.e. the times separating the segments. FIG. 2C illustrates this windowing step.

During this windowing, for each analysis time, a portion of the signal windowed around that time is selected. This signal portion is called the "short-term signal" and, in this example, has a duration corresponding to twice the modified pitch, as shown in FIG. 2C.

The modification processing finally comprises summing the short-term signals that are recentered on the synthesis times and added as shown in FIG. 2D.

In the embodiments of the invention described above by way of example, the modification coefficients chosen are constant. However, the general method of the invention described above can be implemented to effect audio signal modifications in application of coefficients $\alpha$, $\beta$, and $\gamma$ that are not constant. Division into frames (preferably pitch-synchronous frames) can then be effected, for example, and constant modification coefficients can be determined for each frame. The steps E12 and E13 are then effected independently on each of the frames. The frames are then combined by a standard overlap and add technique to reconstruct the required transformed signal.

An audio signal modification method of the invention as described above is in practice implemented by an audio signal processor device, more specifically a speech signal processing device. Such devices therefore include hardware, in particular electronics, and/or software adapted to implement the method of the invention.

In a preferred embodiment, the steps of the audio signal modification method of the invention are determined by the instructions of a computer program used in this kind of processor device, typically consisting of a data processing system, for example a personal computer.

The method of the invention is then executed when the aforementioned program is loaded into data processing means incorporated in the audio processor device, whose operation is then controlled by the program.

Here, "computer program" means one or more computer programs forming a set (software) whose function is to implement the invention when it is executed by an appropriate data processing system.

Consequently, the invention also consists in a computer program of this kind, in particular in the form of software stored on an information medium, which can be any entity or device capable of storing a program according to the invention.

For example, the medium in question can include hardware storage means, such as a ROM, for example a CD ROM or a microelectronic circuit ROM, or magnetic storage means, for example a hard disk. Alternatively, the information medium can be an integrated circuit into which the program is incorporated and adapted to execute the method in question or to be used in its execution.

Moreover, the information medium can also be an immaterial transmissible medium, such as an electrical or optical signal that can be routed via an electrical or optical cable, by radio or by other means. A program according to the invention can in particular be downloaded over an Internet-type network.

From the design point of view, a computer program according to the invention can use any programming language and take the form of source code, object code or an intermediate code between source code and object code (for example a partially compiled form), or any other form desirable for implementing a method of the invention.

Of course, the present invention is in no way limited to the embodiments described and shown in the context of the present description, and on the contrary encompasses any variant that is evident to the person skilled in the art.

REFERENCES CITED

[Syr85] A. K. Syrdal and S. A. Steele, "Vowel F1 as a function of speaker fundamental frequency", $110^{th}$ Meeting of JASA, vol. 78, Fall 1985.

[Mou95] E. Moulines and J. Laroche, "Non-parametric techniques for pitch-scale and time-scale modification of speech", Speech Communication, vol. 16, pp. 175-205, 1995.

[Sty96] Y. Stylianou, "Harmonic plus Noise Model for speech, combined with statistical methods, for speech and speaker modification", PhD thesis, Ecole Nationale Supérieure des Télécommunications, France, 1996.

[Kai00] A. Kain and Y. Stylianou, "Stochastic modeling of spectral adjustment for high quality pitch modification", in Proceedings of ICASSP'00, vol. 2, pp. 949-952, June 2000.

[Hub99] J. E. Huber, E. T. Stathopoulos, G. M. Curione, T. A. Ash and K. Johnson, "Formants of children, women, and men: the effect of vocal intensity variation", Journal of the Acoustical Society of America, 106 (3), pp. 1532-1542, September 1999.

We claim:

1. A method of modifying acoustic characteristics of an original audio signal as a function of modification instructions relating at least to the fundamental frequency and the spectral envelope of the original signal, wherein:

- a first modification operation is applied to the original signal to deliver an intermediate audio signal, the first modification operation being intended to deform the spectral envelope of the original signal in application of said spectral envelope modification instruction; and
- a second modification operation is applied to the intermediate signal to deliver a final audio signal, the second modification operation being intended to modify at least the fundamental frequency of the intermediate signal, in application of a modification factor that is determined so as to take account of the effects of the first modification operation on the fundamental frequency of the original audio signal, so that the fundamental frequency obtained for the final signal conforms to said instruction relating to fundamental frequency.

2. The method according to claim 1, wherein:

the original audio signal modification instructions include a factor $\gamma$ for expanding/contracting the spectral envelope of the original signal along the frequency axis and factors $\beta$ and $\alpha$ for respectively modifying the fundamental frequency and the duration of the original signal;

the first modification operation modifies the fundamental frequency and the duration of the original audio signal in application of second factors $\beta'$ and $\alpha'$, respectively, in addition to the required modification of the spectral envelope; and the second modification operation modifies the fundamental frequency and the duration of the intermediate audio signal in application of third factors $\beta''$ and $\alpha''$, respectively, such that:

$$\alpha'\cdot\alpha''=\alpha \text{ and } \beta'\cdot\beta''=\beta.$$

3. The method according to claim 2, wherein:

the first modification operation is effected by resampling with a resampling factor $\gamma$, a value of $\gamma$ greater than 1 corresponds to expanding the spectral envelope of the signal, and a value of $\gamma$ between 0 and 1 corresponds to contracting the spectral envelope of the signal;

the second factors $\beta'$ and $\alpha'$ are respectively defined as a function of the resampling factor $\gamma$ by the following equations:

$$\beta'=\gamma \text{ and}$$

$$\alpha' = \frac{1}{\gamma}; \text{ and}$$

the third factors $\beta''$ and $\alpha''$ are obtained from the following equations:

$$\beta'' = \frac{\beta}{\gamma} \text{ and}$$

$$\alpha''=\alpha\cdot\gamma.$$

4. The method according to claim 1, wherein the second modification operation is effected by a PSOLA technique.

5. The method according to claim 2, wherein the second modification operation is effected before the first modification operation and the factors $\beta'$ and $\alpha'$ are determined beforehand as a function of the factor $\gamma$.

6. The method according to claim 2, wherein the audio signal to be modified is a speech signal and the modification factors $\alpha,\beta,\gamma$ respectively modify the following parameters relating to the characteristics of reproduction of the speech signal as sound: speed, perceived pitch, and perceived timbre.

7. An audio processing computer program stored on a non-transitory computer-readable medium, including program instructions adapted to implement a method according to claim 1 when it is executed by a data processing system.

8. An audio processor device adapted to modify acoustic characteristics of an original audio signal as a function of modification instructions relating at least to the fundamental frequency and the spectral envelope of the original signal, including:

means for modifying the original audio signal by applying a first modification operation to deliver an intermediate audio signal, the first modification operation being intended to deform the spectral envelope of the original signal in application of said spectral envelope modification instruction; and means for modifying the intermediate signal by applying a second modification operation to deliver a final audio signal, the second modification operation being intended to modify at least the fundamental frequency of the intermediate signal, in application of a modification factor that is determined so as to take account of the effects of the first modification operation on the fundamental frequency of the original audio signal, so that the fundamental frequency obtained for the final signal conforms to said instruction relating to fundamental frequency.

9. The device according to claim 8, including means for executing a modification method, wherein:

a first modification operation is applied to the original signal to deliver an intermediate audio signal, the first modification operation being intended to deform the spectral envelope of the original signal in application of said spectral envelope modification instruction;

a second modification operation is applied to the intermediate signal to deliver a final audio signal, the second modification operation being intended to modify at least the fundamental frequency of the intermediate signal, in application of a modification factor that is determined so as to take account of the effects of the first modification operation on the fundamental frequency of the original audio signal, so that the fundamental frequency obtained for the final signal conforms to said instruction relating to fundamental frequency;

the original audio signal modification instructions include a factor $\alpha$ for expanding/contracting the spectral envelope of the original signal along the frequency axis and factors $\beta$ and $\alpha$ for respectively modifying the fundamental frequency and the duration of the original signal;

the first modification operation modifies the fundamental frequency and the duration of the original audio signal in application of second factors $\beta'$ and $\alpha'$, respectively, in addition to the required modification of the spectral envelope; and the second modification operation modifies the fundamental frequency and the duration of the intermediate audio signal in application of third factors $\beta''$ and $\alpha''$, respectively, such that:

$$\alpha'\cdot\alpha''=\alpha \text{ and } \beta'\cdot\beta''=\beta.$$

* * * * *